US011891240B2

(12) United States Patent
Erm

(10) Patent No.: US 11,891,240 B2
(45) Date of Patent: Feb. 6, 2024

(54) MAIN BODY OF CARRYING BOX

(71) Applicant: SYSPAC SUPPLY CHAIN CO., LTD., Hwaseong-si (KR)

(72) Inventor: Won Sun Erm, Hwaseong-si (KR)

(73) Assignee: SYSPAC SUPPLY CHAIN Co., Ltd., Hwaseong-si (KR)

( * ) Notice: Subject to any disclaimer, the term of this patent is extended or adjusted under 35 U.S.C. 154(b) by 242 days.

(21) Appl. No.: 17/274,433

(22) PCT Filed: Sep. 24, 2019

(86) PCT No.: PCT/KR2019/012421
§ 371 (c)(1),
(2) Date: Mar. 9, 2021

(87) PCT Pub. No.: WO2020/080691
PCT Pub. Date: Apr. 23, 2020

(65) Prior Publication Data

US 2022/0048705 A1 Feb. 17, 2022

(30) Foreign Application Priority Data

Oct. 19, 2018 (KR) ..... 10-2018-0124850

(51) Int. Cl.
*B65D 6/18* (2006.01)
*B65D 88/52* (2006.01)
(Continued)

(52) U.S. Cl.
CPC ..... *B65D 88/524* (2013.01); *B65D 88/121* (2013.01); *B65D 90/023* (2013.01); *B65D 90/08* (2013.01)

(58) Field of Classification Search
CPC .. B65D 88/524; B65D 88/121; B65D 90/023; B65D 90/08; B65D 11/18; B65D 11/1853
(Continued)

(56) References Cited

U.S. PATENT DOCUMENTS 4,673,087 A 6/1987 Webb
4,828,132 A 5/1989 Francis, Jr. et al.
(Continued)

FOREIGN PATENT DOCUMENTS

GB 561583 A 5/1944
JP 2002-159236 A 6/2002
(Continued)

OTHER PUBLICATIONS

International Search Report in International Application No. PCT/KR2019/012421, dated Dec. 30, 2019, 2pages.

*Primary Examiner* — John K Fristoe, Jr.
*Assistant Examiner* — Elizabeth J Volz
(74) *Attorney, Agent, or Firm* — Park, Kim & Suh, LLC

(57) ABSTRACT

A main body for a carrying box includes first and second side walls, and a pair of first connection walls and a pair of second connection walls that are pivotally hinged to opposite ends of the first and second side walls and are pivotally hinged to each other. The main body further includes a latch assembly having a bracket and a latch disposed at the first and second side walls, respectively. When the first and second connection walls pivot, a distance between the first and second side walls is reduced and a volume of the main body is reduced. The bracket is automatically fastened to the latch as the bracket and the latch are pressed toward each other.

11 Claims, 9 Drawing Sheets

(51) Int. Cl.
*B65D 88/12* (2006.01)
*B65D 90/02* (2019.01)
*B65D 90/08* (2006.01)

(58) Field of Classification Search
USPC ..... 220/1.5, 6
See application file for complete search history.

(56) References Cited

U.S. PATENT DOCUMENTS

2012/0248105 A1* 10/2012 Leong ..... E05B 83/02
220/6
2013/0092685 A1* 4/2013 Erm ..... B65D 19/18
220/6

FOREIGN PATENT DOCUMENTS

| | | | |
|---|---|---|---|
| JP | 2002-264993 | A | 9/2002 |
| JP | 2011-121631 | A | 6/2011 |
| KR | 10-0627177 | B1 | 9/2006 |
| KR | 10-1027940 | B1 | 4/2011 |
| WO | 2006/086830 | A1 | 8/2006 |

* cited by examiner (B)

(A)

MAIN BODY OF CARRYING BOX

CROSS-REFERENCE TO RELATED APPLICATIONS

This application is the National Stage filing under 35 U.S.C. 371 of International Application No. PCT/KR2019/012421, filed on Sep. 24, 2019 which claims the benefit of Korean Patent Application No. 10-2018-0124850, filed on Oct. 19, 2018, the contents of which are all hereby incorporated by reference herein in their entirety.

The present disclosure relates to a main body of a carrying box, and more particularly to a main body of a carrying box capable of pivoting and being folded by a hinge structure to reduce a volume thereof.

BACKGROUND ART

In general, large cargoes that are bulgy and heavy are transported in a carrying box. In this case, the carrying box may be made with a large inner space enough to accommodate large cargoes and may be made of a sturdy material to withstand the weight of large cargoes.

As such, a carry box containing a large cargo is transported by ships, aircrafts, or the like. In the case of transportation using an aircraft or the like, transportation costs are determined by the volume, the weight, and the like of the cargo.

However, when a large cargo is packed in a carrying box and delivered to the destination and then the empty carrying box is retrieved, if the volume of the carrying box is not capable of being reduced, unnecessary transportation costs are consumed, and thus the total logistics cost may increase significantly. In addition, when an unused carrying box is stored, if the volume of the carrying box is not also capable of being reduced, storage costs rise, which also acts as a factor that increases the logistics cost.

Accordingly, there is a need to develop a carrying box that is capable of reducing the logistics cost by reducing the volume of a carrying box when retrieving or storing the carrying box.

DISCLOSURE

Technical Problem

An object of the present disclosure is to provide a main body of a carrying box capable of being folded by a hinge structure to reduce the volume thereof when the carrying box is retrieved or stored.

Another object of the present disclosure is to provide a main body of a carrying box that maintains its reduced volume and is prevented from being unintentionally unfolded to be damaged or broken while the carrying box is retrieved or stored.

Technical Solution

In accordance with an aspect of the present disclosure, the above and other objects can be accomplished by the provision of a main body of a carrying box including a first side wall and a second side wall that form a side wall of the main body, and a pair of first connection walls and a pair of second connection walls that are pivotally hinged to opposite ends of the first side wall, respectively, and the second side wall and are pivotally hinged to each other to overlap each other, wherein, when the pair of first connection walls and the pair of second connection walls pivot to overlap each other, a distance between the first side wall and the second side wall is reduced and a volume of the main body is reduced.

The pair of first connection walls and the pair of second connection walls may be pivotally hinged to an end and a remaining end of the first side wall and an end and a remaining end of the second side wall, respectively, by a second hinge portion, and the pair of first connection walls and the pair of second connection walls may be pivotally hinged to each other by a first hinge portion.

The pair of first connection walls and the pair of second connection walls may pivot in an opposite direction to the end and the remaining end of the first side wall and the end and the remaining end of the second side wall, respectively, to overlap each other from a position at which the first connection walls and the second connection walls may be perpendicularly connected to the end and the remaining end of the first side wall and the end and the remaining end of the second side wall, respectively.

The first hinge portion may be disposed between a first connection wall and a second connection wall, and may pivotally hinge the first connection wall and the second connection wall to overlap each other from a state in which the first connection wall and the second connection wall are disposed in a straight line.

The first hinge portion may include a first central hinge housing and a second central hinge housing that are detachably connected to an end of the first connection wall and an end of the second connection wall, which face each other, respectively, and a central elastic member configured to pivotally hinge the first central hinge housing and the second central hinge housing to each other.

A first central fixing member and a second central fixing member may be fixedly inserted into the first central hinge housing and the second central hinge housing, respectively, and opposite ends of the central elastic member may be fixed to the first central hinge housing and the second central hinge housing by the first central fixing member and the second central fixing member, respectively.

The second hinge portion may be disposed between the first side wall and the first connection wall or between the second side wall and the second connection wall, may pivotally hinge the first side wall and the first connection wall to overlap each other from a state in which the first side wall and the first connection wall are perpendicularly connected to each other, and may pivotally hinge the second side wall and the second connection wall to overlap each other from a state in which the second side wall and the second connection wall are perpendicularly connected to each other.

The second hinge portion may include a first corner hinge housing and a second corner hinge housing that are detachably connected to an end of the first side wall and an end of the first connection wall, which face each other, respectively, or an end of the second side wall and an end of the second connection wall, which face each other, respectively, and a corner elastic member configured to pivotally hinge the first corner hinge housing and the second corner hinge housing to each other.

A first corner fixing member and a second corner fixing member may be fixedly inserted into the first corner hinge housing and the second corner hinge housing, respectively, and opposite ends of the corner elastic member may be fixed to the first corner hinge housing and the second corner hinge housing by the first corner fixing member and the second corner fixing member, respectively.

The main body of the carrying box may further include a latch assembly configured to, when a distance between the first side wall and the second side wall is reduced, maintain the reduced distance between the first side wall and the second side wall.

The latch assembly may include a latch disposed at any one of the first side wall and the second side wall, and a bracket that is disposed at a remaining side of the first side wall and the second side wall and is selectively inserted into and coupled to the latch.

The bracket may include a hang bar inserted into and coupled to the latch, and the latch may include a lever and a catcher that are pivotally configured to fix the hang bar when the hang bar is inserted into the latch.

The latch may further include a latch frame disposed on any one of the first side wall and the second side wall, the lever may be pivotally installed on the latch frame, a handle of one end of the lever is exposed to an outside, and a lever stopper and a lever curve portion are formed at a remaining end, and the catcher may be pivotally disposed at the latch frame, is provided with elastic force to pivot in one direction, and includes a catcher groove in which the hang bar is accommodated, a catcher curved portion, and a catcher stopper.

Before the hang bar is coupled to the latch, the lever curve portion and the catcher curved portion may interfere with each other to limit pivot of the lever and the catcher, and when the hang bar is inserted into the catcher groove while pivoting the catcher in an opposite direction to the elastic force, the lever stopper and the catcher stopper may interfere with each other to limit pivot of the catcher and to fix the hang bar to the catcher groove.

Advantageous Effects

When the main box of the carrying box according to the present disclosure is used, it may be possible to fold the carrying box by a hinge structure in order to reduce the volume of the carrying box while the carrying box is retrieved or stored, thereby remarkably reducing the logistics cost.

According to the present disclosure, the volume of the main body, which is reduced by the latch assembly, may be maintained, and thus the main body may be prevented from being unintentionally unfolded to be damaged or broken while the carrying box is retrieved or stored.

BEST MODE

Figure 1:
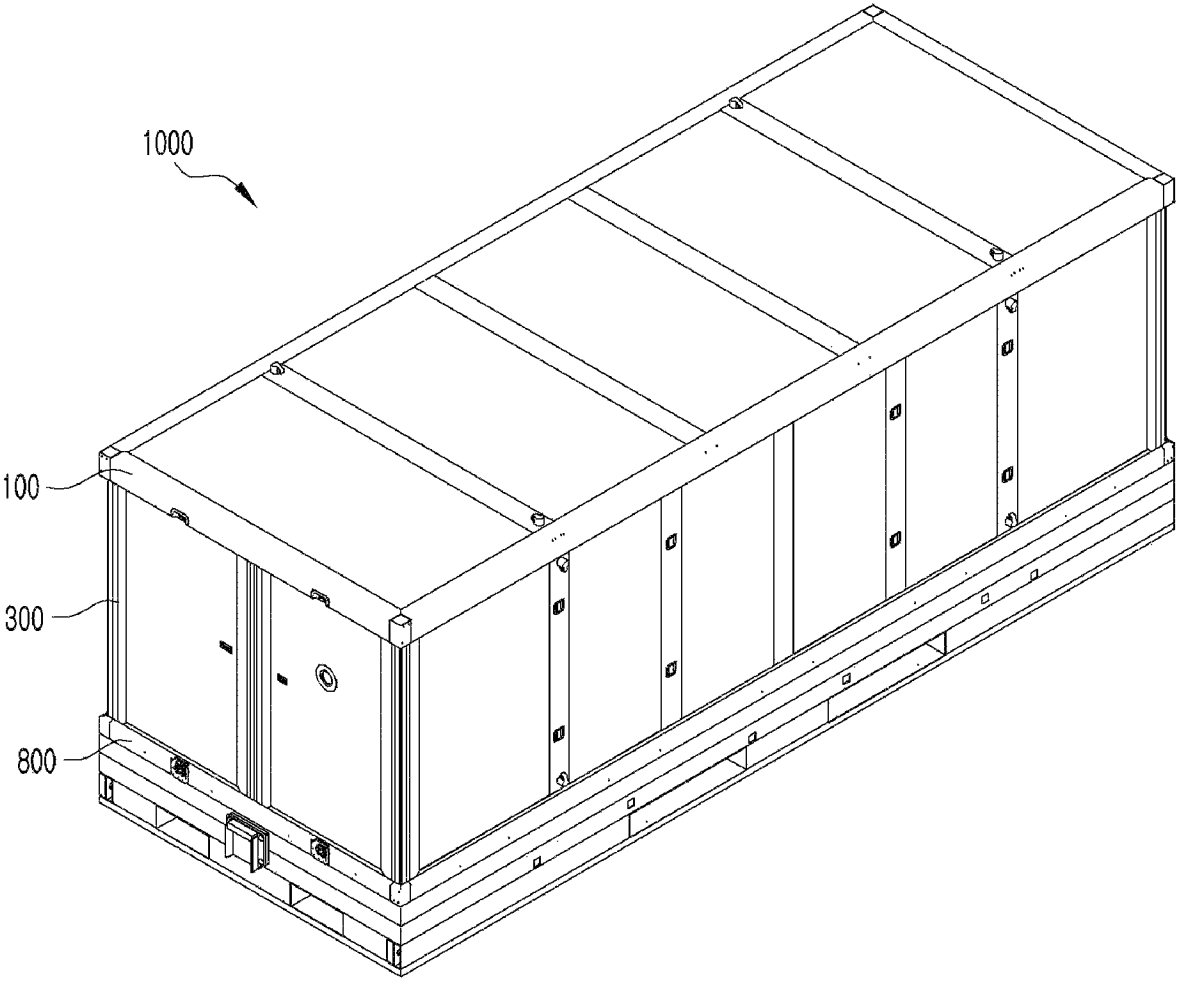
FIG. 1 is a perspective view of an entire carrying box.

Hereinafter, exemplary embodiments of the present disclosure will be described in detail with reference to the accompanying drawings. Unless otherwise defined, all terms in the specification have the same meaning as general meaning of the terms understood by one of ordinary skill in the art to which the present disclosure belongs, and if the terms used in the specification conflict with the general meaning of the terms, the present disclosure is understood in accordance with the definitions used herein. The configuration or control method of the device to be described below is for explaining the embodiment of the present disclosure, not to limit the scope of the present disclosure. Throughout the specification, the same elements are denoted by the same reference numerals.

Hereinafter, a main body of a carrying box according to various embodiments of the present disclosure will be described with reference to the drawings.

Figure 2:
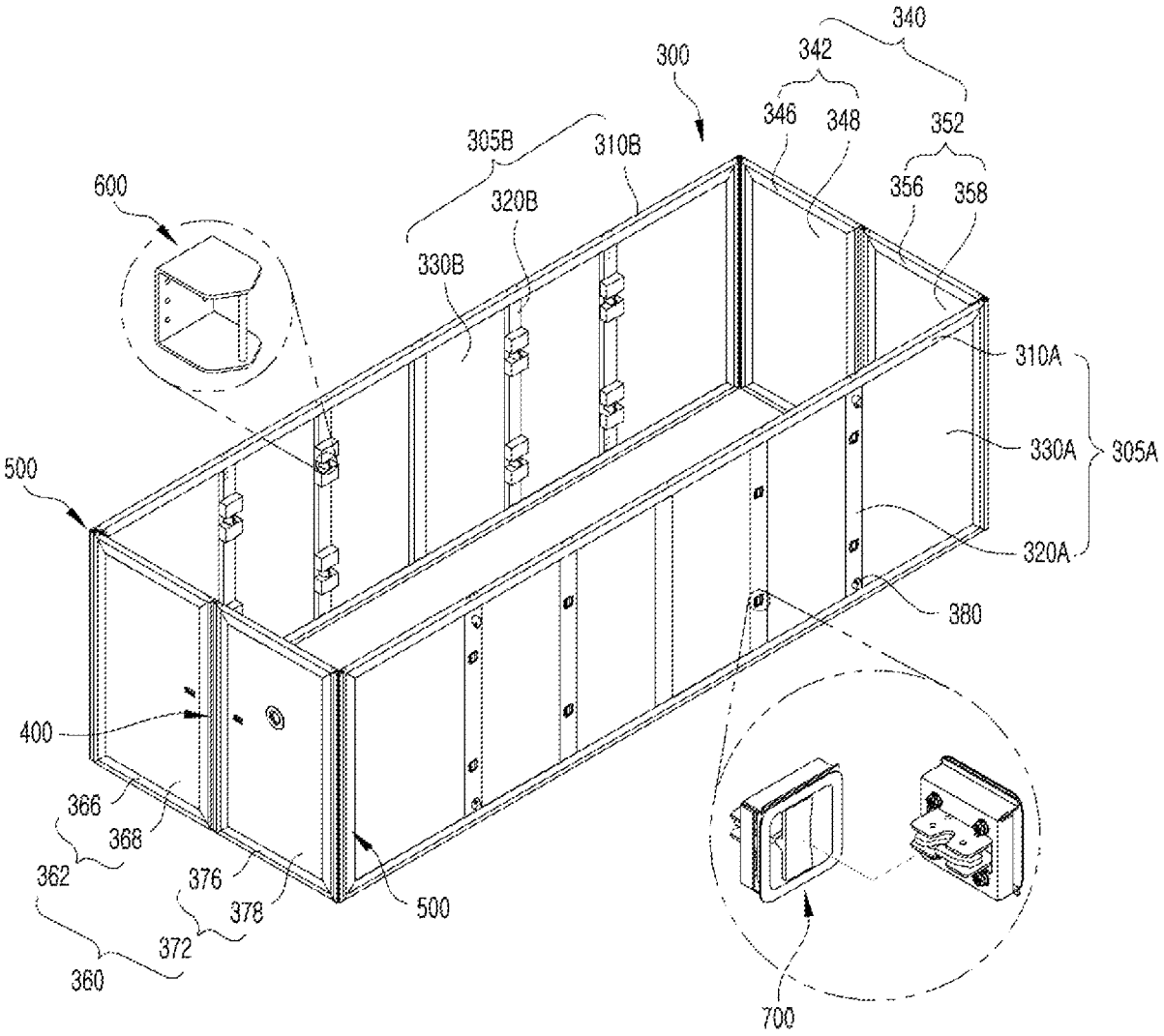
FIG. 2 is a perspective view of a main body configured by omitting an upper cover and a lower pallet from the carrying box.

FIG. 1 is a perspective view of an entire carrying box 1000. FIG. 2 is a perspective view of a main body 300 configured by omitting an upper cover 100 and a lower pallet 800 from the carrying box 1000.

Referring to FIGS. 1 and 2, the carrying box 1000 may include the main body 300, the cover 100 assembled to an upper portion of the main body 300, and the pallet 800 that is assembled to a lower portion of the main body 300 and supports the main body 300.

When carrying various articles using an aircraft or the like, the carrying box 1000 may provide an accommodation space for accommodating the articles therein.

The carrying box 1000 may be configured to minimize the volume thereof in order to reduce the logistics cost when an article is delivered to the destination and then the empty carrying box is retrieved. Accordingly, the main body 300 of the carrying box 1000 according to the present disclosure may be foldable to reduce the entire volume of the carrying box 1000, which will be described below in detail.

The main body 300 of the carrying box may include a first side wall 305B and a second side wall 305A which form a side wall, and a pair of first connection walls 362 and 342 and a pair of second connection walls 372 and 352 that are pivotally hinged to opposite ends of the first side wall 305B and the second side wall 305A, respectively and are pivotally hinged to each other to overlap each other, and when the pair of first connection walls 362 and 342 and the pair of second connection walls 372 and 352 pivot to overlap each other, a distance between the first side wall 305B and the second side wall 305A may be reduced and the volume of the main body 300 may be reduced.

As shown in FIG. 2, the main body 300 may include the first side wall 305B and the second side wall 305A that form a side walls.

The first side wall 305B may include a first frame 310B, a first side wall plate 330B that is disposed inside the first frame 310B and forms a wall surface, and a first middle frame 320B in which a latch assembly 900 (refer to FIG. 6) to be described below is to be disposed.

The first frame 310B may form a frame of the first side wall 305B, and pieces of the first frame 310B may be connected by the first side wall plate 330B to form a wall surface. At least one first middle frame 320B may be disposed in a vertical direction between the pieces of the first frame 310B.

When the latch assembly 900 may be mounted on the first middle frame 320B and the first side wall 305B and the second side wall 305A become close to each other, the latch assembly 900 may be fixed to the first middle frame 320B to maintain a distance between the first side wall 305B and the second side wall 305A. The latch assembly 900 will be described below in detail.

A hook member 380 may be provided at a portion of the first middle frame 320B. For example, as shown in the drawings, the hook member 380 may be provided in the first middle frame 320B to avoid a latch 700 or a bracket 600.

As such, when the hook member 380 is provided, if the main body 300 according to the present embodiment is folded and is coupled to an internal side of an upper portion of the pallet 800, a rope 10 (refer to FIG. 9) may be connected to the hook member 380, and the main body 300 may be lifted and may be stably moved using the rope 10 connected to a lift device such as a crane (not shown), which will be described below in detail.

The second side wall 305A may have a symmetrical structure with the first side wall 305B or the same structure as the first side wall 305B.

For example, the second side wall 305A may include a second frame 310A, a second side wall plate 330A that is disposed at an internal side of the second frame 310A and forms a wall surface, and a second intermediate frame 320A on which the latch assembly 900 is to be disposed.

Descriptions of the second frame 310A, the second side wall plate 330A, and the second intermediate frame 320A are similar to a description of the first side wall 305B, and thus a repeated description will be omitted.

A pair of connection walls 340 and 360 for respectively connecting opposite ends of the first side wall 305B and opposite ends of the second side wall 305A may be provided. In this case, the pair of connection walls 340 and 360 may be respectively connected to the opposite ends of the first side wall 305B and the opposite ends of the second side wall 305A while having the same structure.

In detail, the pair of first connection walls 362 and 342 and the pair of second connection walls 372 and 352 may be pivotally hinged to one end and the other end of the first side wall 305B and one end and the other end of the second side wall 305A, respectively, and the pair of first connection walls 362 and 342 and the pair of second connection walls 372 and 352 may be pivotally hinged to each other by a first hinge portion 400.

The first connection walls 362 and 342 may include first connection frames 366 and 346 and first connection plates 368 and 348 that are disposed inside the first connection frames 366 and 346 and form a wall surface.

The second connection walls 372 and 352 may include second connection frames 376 and 356 and second connection plates 378 and 358 that are disposed inside the second connection frames 376 and 356 and form a wall surface.

The first connection walls 362 and 342 may be connected to opposite ends of the first side wall 305B to pivot using a second hinge portion 500. In this case, the first connection walls 362 and 342 may be connected to opposite ends of the first side wall 305B, respectively, to pivot towards the first side wall 305B from the position at which the first connection walls 362 and 342 are perpendicularly connected to the opposite ends of the first side wall 305B.

Similarly, the second connection walls 372 and 352 may be pivotally hinged to opposite ends of the second side wall 305A by the second hinge portion 500. In this case, the second connection walls 372 and 352 may be connected to opposite ends of the second side wall 305A, respectively, to pivot towards the second side wall 305A from the position at which the second connection walls 372 and 352 are perpendicularly connected to the opposite ends of the second side wall 305A.

The first connection walls 362 and 342 and the second connection walls 372 and 352 may be pivotally hinged to each other, respectively, to overlap each other towards an internal side of the main body 300 from the state in which the first connection walls 362 and 342 and the second connection walls 372 and 352 are connected to each other in a straight line, as shown in FIG. 2.

Figure 3:
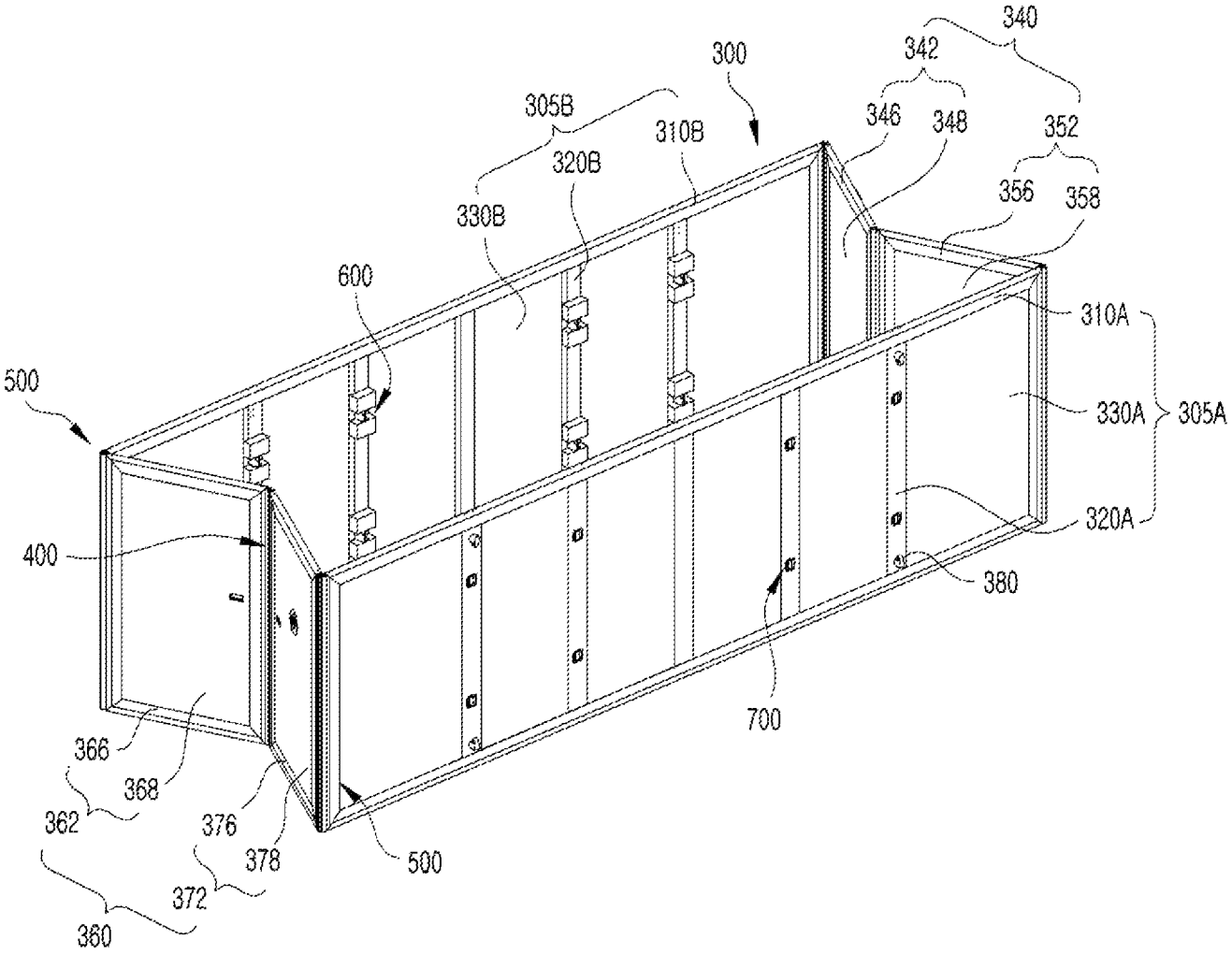
FIG. 3 is a diagram showing the state in which the first connection walls and the second connection walls pivot to overlap each other from the aforementioned state of FIG. 2.

FIG. 3 is a diagram showing the state in which the first connection walls 362 and 342 and the second connection walls 372 and 352 pivot to overlap each other from the aforementioned state of FIG. 2.

Referring to FIG. 3, the first connection walls 362 and 342 and the second connection walls 372 and 352 may pivot to overlap each other towards an internal side of the main body 300 as shown in FIG. 3 from the state in which the first connection walls 362 and 342 and the second connection walls 372 and 352 are connected to each other in a straight line.

That is, the first connection wall 362 and the second connection wall 372 may pivot in an opposite direction to one end of the first side wall 305B and one end of the second side wall 305A to overlap each other from the position at which the first connection wall 362 and the second connection wall 372 are perpendicularly connected to one end of the first side wall 305B and one end of the second side wall 305A, respectively.

Similarly, the first connection wall 342 and the second connection wall 352 that are connected to the other end of the first side wall 305B and the other end of the second side wall 305A, respectively, may pivot in an opposite direction to the other end of the first side wall 305B and the other end of the second side wall 305A to overlap each other.

In this case, the first connection walls 362 and 342 and the second connection walls 372 and 352 may be pivotally hinged to each other, respectively, by the first hinge portion 400. The first connection walls 362 and 342 may be pivotally hinged to opposite ends of the first side wall 305B, respectively, by the second hinge portion 500, and the second connection walls 372 and 352 may be pivotally hinged to opposite ends of the second side wall 305A, respectively, by the second hinge portion 500.

In this case, the first connection walls 362 and 342 and the second connection walls 372 and 352 may pivot to overlap each other towards an internal side of the main body 300, as shown in FIG. 3, from the state in which the first connection walls 362 and 342 and the second connection walls 372 and 352 are connected to each other in a straight line, as shown in FIG. 2, and the first connection walls 362 and 342 and the second connection walls 372 and 352 may pivot using the aforementioned first hinge portion 400 and second hinge portion 500.

Figure 4:
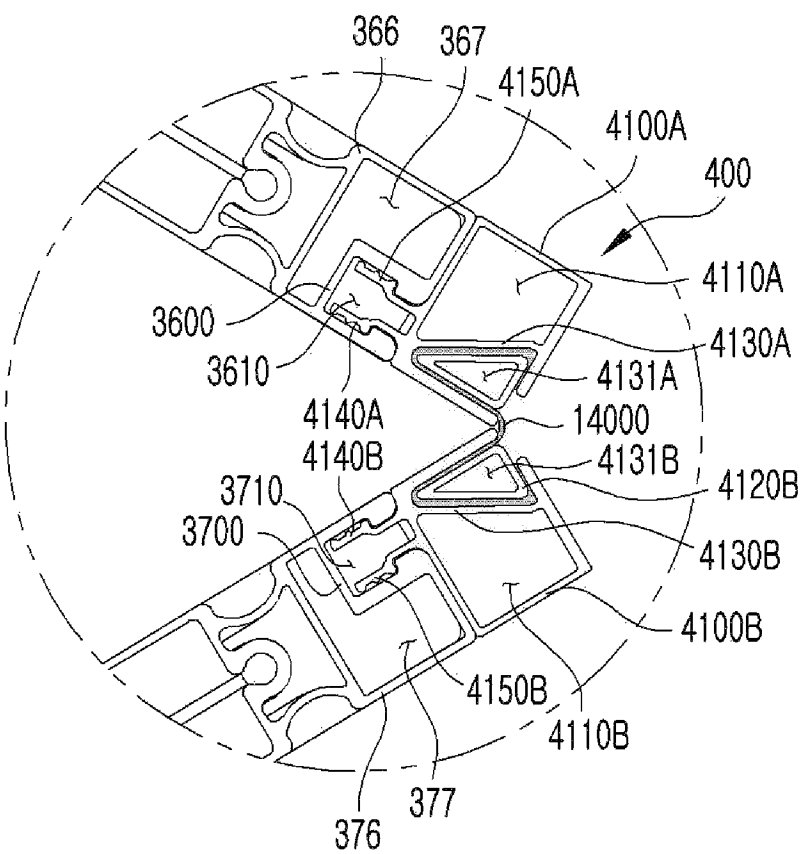
FIG. 4 is a set of diagrams showing the structure and pivot operation of a first hinge portion.
Figure 4:
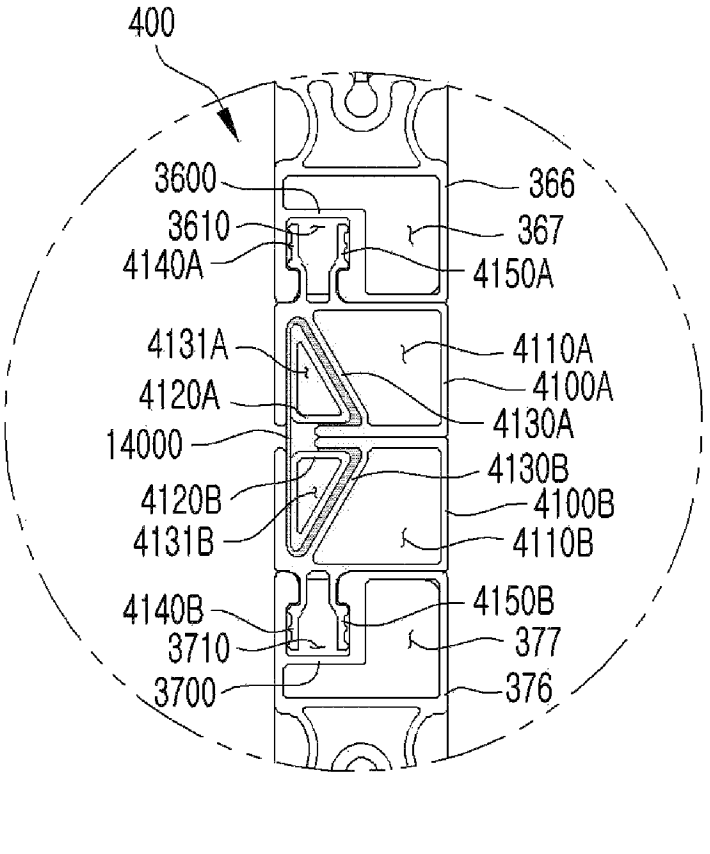

FIG. 4 is a set of diagrams showing the structure and pivot operation of the first hinge portion 400. FIG. 4A shows the state in which the first connection wall 362 and the second connection wall 372 are connected to each other in a straight line. FIG. 4B shows the state in which the first connection wall 362 and the second connection wall 372 pivot in an opposite direction to each other and become close to each other around the first hinge portion 400.

Referring to FIG. 4, the first hinge portion 400 may be disposed between the first connection wall 362 and the second connection wall 372, and the first connection wall 362 and the second connection wall 372 may be pivotally hinged to each other to overlap each other from the state in which the first connection wall 362 and the second connection wall 372 are connected in a straight line.

In detail, the first hinge portion 400 may include a first central hinge housing 4100A that is detachably connected to an end of the first connection wall 362, and a second central hinge housing 4100B that is detachably connected to an end of the second connection wall 372, and a central elastic member 14000 may be provided to pivotally hinge the first central hinge housing 4100A and the second central hinge housing 4100B to each other.

The first central hinge housing 4100A may be detachably connected to the end of the first connection wall 362. Since the first central hinge housing 4100A is detachably configured, when future maintenance is required, it may be possible to perform simple and quick maintenance by only separating the first central hinge housing 4100A.

For example, the first central hinge housing 4100A may include first central flanges 4140A and 4150A that are formed to protrude, and a first central groove 3610 may be formed at the end of the first connection wall 362, in more detail, an end of the first connection frame 366. The first central groove 3610 may be formed by a first barrier wall 3600 included in an internal space 367 of the first central hinge housing 4100A.

Thus, the first central flanges 4140A and 4150A of the first central hinge housing 4100A may be fixedly inserted into the first central groove 3610 and the first central hinge housing 4100A may be fixed to the end of the first connection wall 362.

Similarly, the second central hinge housing 4100B may be detachably connected to the end of the second connection wall 372. Since the second central hinge housing 4100B is detachably configured, when future maintenance is required, it may be possible to perform simple and quick maintenance by only separating the second central hinge housing 4100B.

For example, the second central hinge housing 4100B may include second central flanges 4140B and 4150B that are formed to protrude, and a second central groove 3710 may be formed at the end of the second connection wall 372, in more detail, an end of the second connection frame 376. The second central groove 3710 may be formed by a second barrier wall 3700 included in an internal space 377 of the second central hinge housing 4100B.

Thus, the second central flanges 4140B and 4150B of the second central hinge housing 4100B may be fixedly inserted into the second central groove 3710 and the second central hinge housing 4100B may be fixed to the end of the second connection wall 372.

In this case, the first central hinge housing 4100A and the second central hinge housing 4100B may be pivotally hinged to each other by the central elastic member 14000. The central elastic member 14000 may be formed of an appropriate material that has elasticity and flexibility for enabling pivot and is prevented from being damaged and broken to increase a lifetime thereof. For example, the central elastic member 14000 may be formed of a material such as synthetic resin to achieve elasticity and appropriate strength.

Opposite ends of the central elastic member 14000 may be fixedly connected to the first central hinge housing 4100A and the second central hinge housing 4100B, respectively.

In detail, a first central fixing member 4120A may be fixedly inserted into the first central hinge housing 4100A, and a second central fixing member 4120B may be fixedly inserted into the second central hinge housing 4100B.

The first central fixing member 4120A may be fixedly inserted into a coupling groove 4131A of the first central hinge housing 4100A in the state in which one end of the central elastic member 14000 surrounds the first central fixing member 4120A. The coupling groove 4131A may be formed by a third barrier wall 4130A included in an internal space 4110A of the first central hinge housing 4100A.

In this case, an interval between the first central fixing member 4120A and the coupling groove 4131A may be formed to be smaller than the thickness of the central elastic member 14000. In this case, the central elastic member 14000 may be fixed while being compressed and pressed by the first central fixing member 4120A and the coupling groove 4131A.

Similarly, the second central fixing member 4120B may be fixedly inserted into a coupling groove 4131B of the second central hinge housing 4100B in the state in which the other end of the central elastic member 14000 surrounds the second central fixing member 4120B. The coupling groove 4131B may be formed by a fourth barrier wall 4130B included in an internal space 4110B of the second central hinge housing 4100B.

In this case, an interval between the second central fixing member 4120B and the coupling groove 4131B may be formed to be smaller than the thickness of the central elastic member 14000. In this case, the central elastic member 14000 may be fixed while being compressed and pressed by the second central fixing member 4120B and the coupling groove 4131B.

A surface of the first central hinge housing 4100A and a surface of the second central hinge housing 4100B, which face each other, may be formed in a perpendicular direction to the first connection wall 362 and the second connection wall 372. In this case, as shown in FIG. 4A, when the first connection wall 362 and the second connection wall 372 are unfolded, the facing surfaces of the first central hinge housing 4100A and the second central hinge housing 4100B may come in contact with each other, and the first central hinge housing 4100A and the second central hinge housing 4100B may be disposed in a straight line.

Figure 5:
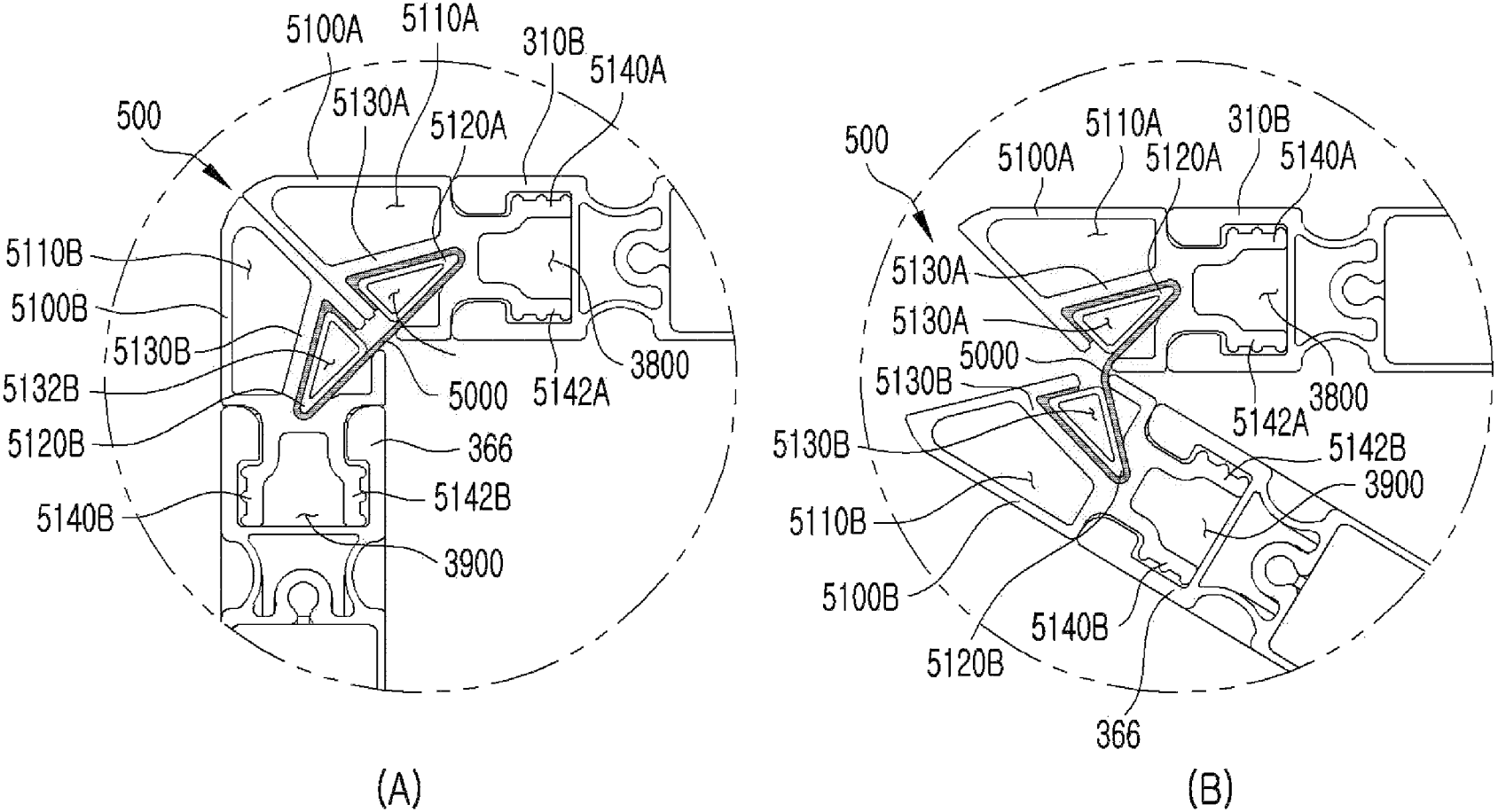
FIG. 5 is a set of diagrams showing the structure and pivot operation of a second hinge portion.

FIG. 5 is a set of diagrams showing the structure and pivot operation of the second hinge portion 500. FIG. 5A shows the state in which the first side wall 305B and the first connection wall 362 are perpendicularly connected to each other. FIG. 5B shows the state in which the first side wall 305B and the first connection wall 362 pivot in an opposite direction to each other and become close to each other around the second hinge portion 500.

Referring to FIG. 5, the second hinge portion 500 may be disposed between the first side wall 305B and the first connection wall 362 or between the second side wall 305A and the second connection wall 372.

In this case, the second hinge portion 500 may pivotally hinge the first side wall 305B and the first connection wall 362 to overlap each other from the state in which the first side wall 305B and the first connection wall 362 are perpendicularly connected to each other, and may also pivotally hinge the second side wall 305A and the second connection wall 372 to overlap each other from the state in which the second side wall 305A and the second connection wall 372 are perpendicularly connected to each other. Hereinafter, the embodiment of the present disclosure will be described in terms of the structure of the second hinge portion 500 for connecting the first side wall 305B and the first connection wall 362.

In detail, the second hinge portion 500 may include a first corner hinge housing 5100A and a second corner hinge housing 5100B that are detachably connected to an end of the first side wall 305B and an end of the first connection wall 362, which face each other, respectively, and in this case, a corner elastic member 5000 may be provided to pivotally hinge the first corner hinge housing 5100A and the second corner hinge housing 5100B to each other.

The first corner hinge housing 5100A may be detachably connected to the end of the first side wall 305B. Since the first corner hinge housing 5100A is detachably configured, when future maintenance is required, it may be possible to perform simple and quick maintenance by only separating the first corner hinge housing 5100A.

For example, the first corner hinge housing 5100A may include first corner flanges 5140A and 5142A that are formed to protrude, and a first corner groove 3800 may be formed at the end of the first side wall 305B, in more detail, an end of the first frame 310B.

Thus, the first corner flanges 5140A and 5142A of the first corner hinge housing 5100A may be fixedly inserted into the first corner groove 3800 and the first corner hinge housing 5100A may be fixed to the end of the first side wall 305B.

Similarly, the second corner hinge housing 5100B may be detachably connected to the end of the first connection wall 362. Since the second corner hinge housing 5100B is detachably configured, when future maintenance is required, it may be possible to perform simple and quick maintenance by only separating the second corner hinge housing 5100B.

For example, the second corner hinge housing 5100B may include second corner flanges 5140B and 5142B that are formed to protrude, and a second corner groove 3900 may be formed at the end of the first connection wall 362, in more detail, an end of the first connection frame 366.

Thus, the second corner flanges 5140B and 5142B of the second corner hinge housing 5100B may be fixedly inserted into the second corner groove 3900, and the second corner hinge housing 5100B may be fixed to the end of the first connection wall 362.

In this case, the first corner hinge housing 5100A and the second corner hinge housing 5100B may be pivotally hinged to each other by the corner elastic member 5000. The corner elastic member 5000 may be formed of an appropriate material that has elasticity and flexibility for enabling pivot and is prevented from being damaged and broken to increase a lifetime thereof. For example, the corner elastic member 5000 may be formed of a material such as synthetic resin to achieve elasticity and appropriate strength and may be formed of the same material as the aforementioned central elastic member 14000.

Opposite ends of the corner elastic member 5000 may be fixedly connected to the first corner hinge housing 5100A and the second corner hinge housing 5100B, respectively.

In detail, a first corner fixing member 5120A may be fixedly inserted into the first corner hinge housing 5100A, and a second corner fixing member 5120B may be fixedly inserted into the second corner hinge housing 5100B.

The first corner fixing member 5120A may be fixedly inserted into a coupling groove 5132A of the first corner hinge housing 5100A in the state in which one end of the corner elastic member 5000 surrounds the first corner fixing member 5120A. In this case, the coupling groove 5132A may be formed by a fifth barrier wall 5130A included in an internal space 5110A of the first corner hinge housing 5100A.

In this case, an interval between the first corner fixing member 5120A and the coupling groove 5132A may be formed to be smaller than the thickness of the corner elastic member 5000. In this case, the corner elastic member 5000 may be fixed while being compressed and pressed by the first corner fixing member 5120A and the coupling groove 5132A.

Similarly, the second corner fixing member 5120B may be fixedly inserted into a coupling groove 5132B of the second corner hinge housing 5100B in the state in which the other end of the corner elastic member 5000 surrounds the second corner fixing member 5120B. In this case, the coupling groove 5132B may be formed by a sixth barrier wall 5130B included in an internal space 5110B of the second corner hinge housing 5100B.

In this case, an interval between the second corner fixing member 5120B and the coupling groove 5132B may be formed to be smaller than the thickness of the corner elastic member 5000. In this case, the corner elastic member 5000 may be fixed while being compressed and pressed by the second corner fixing member 5120B and the coupling groove 5132B.

A surface of the first corner hinge housing 5100A and a surface of the second corner hinge housing 5100B, which face each other, may be formed at a predetermined angle with respect to the first side wall 305B and the first connection wall 362. For example, the facing surfaces of the first corner hinge housing 5100A and the second corner hinge housing 5100B may be formed at an angle of about 45 degrees with respect to the first side wall 305B and the first connection wall 362.

In this case, as shown in FIG. 5A, when the first side wall 305B and the first connection wall 362 are unfolded, the facing surfaces of the first corner hinge housing 5100A and the second corner hinge housing 5100B may come in contact with each other and the first side wall 305B and the first connection wall 362 may be perpendicularly connected to each other.

As shown in FIG. 3, when a distance between the first side wall 305B and the second side wall 305A is reduced by pivot of the connection walls 340 and 360, it may be required to maintain the distance between the first side wall 305B and the second side wall 305A. This is because, if the distance between the first side wall 305B and the second side wall 305A is not maintained, there is the risk that the carrying box may be broken and damaged while being delivered.

Accordingly, as shown in FIG. 2, the main body 300 of the carrying box according to the present disclosure may further include the latch assembly 900 for maintaining the reduced distance between the first side wall 305B and the second side wall 305A when the distance between the first side wall 305B and the second side wall 305A is reduced.

In detail, the latch assembly 900 may include the latch 700 disposed at any one side of the first side wall and the second side wall, and the bracket 600 that is disposed at the other side of the first side wall 305B and the second side wall 305A and is selectively inserted into and coupled to the latch 700.

When the distance between the first side wall 305B and the second side wall 305A is reduced, the reduced distance between the first side wall 305B and the second side wall 305A may be maintained by inserting and coupling the bracket 600 into and to the latch 700.

Figure 6:
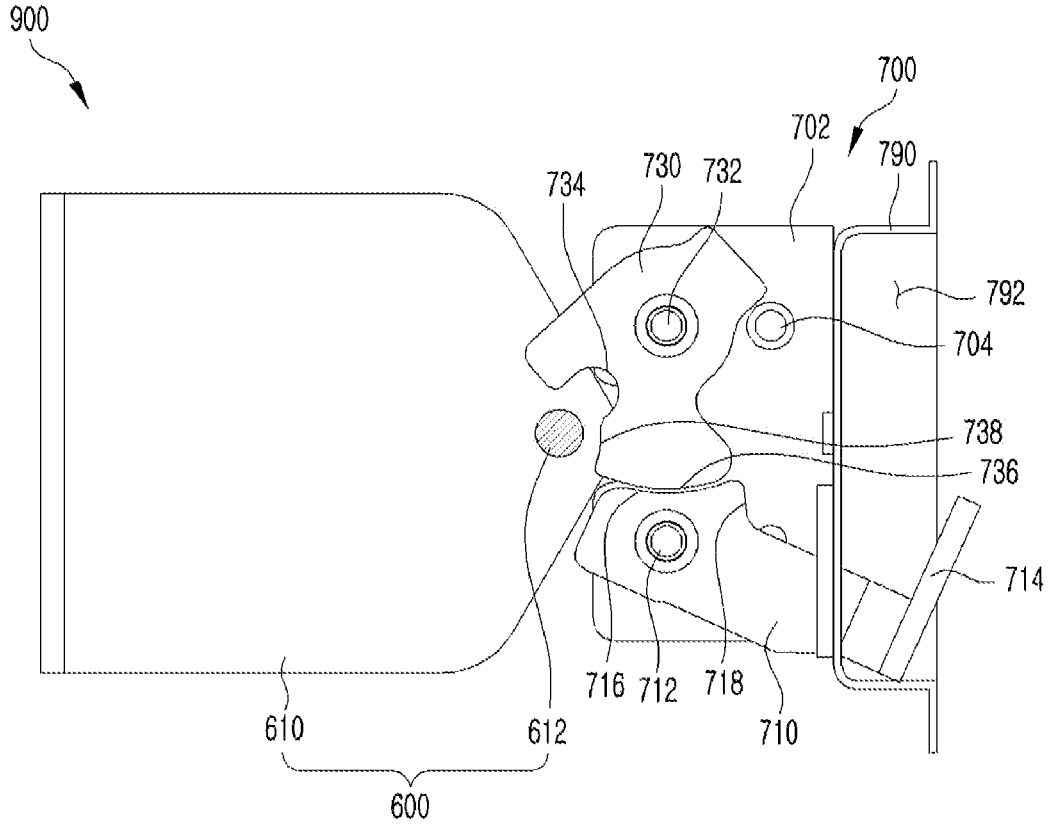
FIG. 6 is a plan view showing the configuration of a bracket and a latch.

FIG. 6 is a plan view showing the configuration of the aforementioned bracket 600 and latch 700.

Referring to FIGS. 2 and 6, the bracket 600 may be installed at any one side of the first side wall 305B and the second side wall 305A. When the bracket 600 is installed at the first side wall 305B, the bracket 600 may be disposed on an internal surface of the first side wall 305B, that is, inside the main body 300. In more detail, the bracket 600 may be installed on the first middle frame 320B of the first side wall 305B, and in this case, may be installed inside the first middle frame 320B.

The bracket 600 may include a parallel plate 610 and a hang bar 612 that extends in a perpendicular direction from the parallel plate 610 and is inserted into and coupled to the latch 700. The hang bar 612 may extend by a predetermined length and may be fixedly inserted into the latch 700.

When the bracket 600 is included in the first side wall 305B, the latch 700 may be installed on the second side wall 305A.

In this case, the latch 700 may include a lever 710 and a catcher 730 that are pivotally configured to fix the hang bar 612 when the hang bar 612 is inserted into the latch 700.

In detail, the latch 700 may further include a latch frame 790 included in the second side wall 305A. The latch frame 790 may installed through the second side wall 305A. In more detail, the latch frame 790 may be installed on the second intermediate frame 320A of the second side wall 305A, and in this case, may be installed through the second intermediate frame 320A.

A recess 792 may be formed outside the latch frame 790, that is, outside the main body 300, and an extension 702 may be formed inside the latch frame 790.

The lever 710 may be pivotally installed on the latch frame 790, and in more detail, may be pivotally hinged to a first pivot shaft 712 of the extension 702.

In this case, a handle 714 may be formed at one end of the lever 710, and the handle 714 may be exposed out of the latch frame 790. That is, as shown in FIG. 6, the handle 714 may be accommodated in the recess 792 and may be exposed to the outside. As such, a coupling state of the latch 700 and the bracket 600 may be released by pulling the handle 714 exposed to the outside by a worker, and thus the main body 300 may be unfolded back to an original state.

A lever curve portion 716 and a lever stopper 718 that have a curved shape may be formed at the other end of the lever 710. When the bracket 600 is not coupled to the latch 700, the lever curve portion 716 may come in contact with the catcher 730 to prevent the catcher 730 from pivoting in one direction. The lever stopper 718 may confine the catcher 730 to prevent the bracket 600 from being released when the bracket 600 is coupled to the latch 700.

The catcher 730 may be pivotally disposed at the latch frame 790, and in more detail, may be pivotally hinged to a second pivot shaft 732 of the extension 702.

In this case, the catcher 730 may be provided with elastic force to pivot in one direction by an elastic member (not shown) such as a spring. When the bracket 600 is not coupled to the latch 700, a pivot limiter 704 may be formed on the extension 702 to prevent the catcher 730 from pivoting due to the elastic force.

For example, in FIG. 6, if the catcher 730 is provided with elastic force to pivot clockwise by the elastic member, the catcher 730 may interfere with the pivot limiter 704 to be prevented from pivoting.

A catcher curved portion 736 corresponding to the lever curve portion 716 may be formed on the catcher 730. When the bracket 600 is not coupled to the latch 700, the catcher curved portion 736 may come in contact with the lever curve portion 716 to prevent the catcher 730 from pivoting in one direction. To this end, the lever curve portion 716 and the catcher curved portion 736 may have respective shapes that correspond to each other. For example, as shown in the drawing, when the lever curve portion 716 has a concave shape, the catcher curved portion 736 may have a convex shape.

The catcher 730 may include a catcher groove 734 shaped like a groove into which the aforementioned hang bar 612 of the bracket 600 is inserted and accommodated, and a catcher stopper 738. When the hang bar 612 of the bracket 600 is inserted into the catcher groove 734, the lever stopper 718 and the catcher stopper 738 may interfere with each other to limit pivot of the catcher 730 and to couple the bracket 600 to the latch 700.

Figure 7:
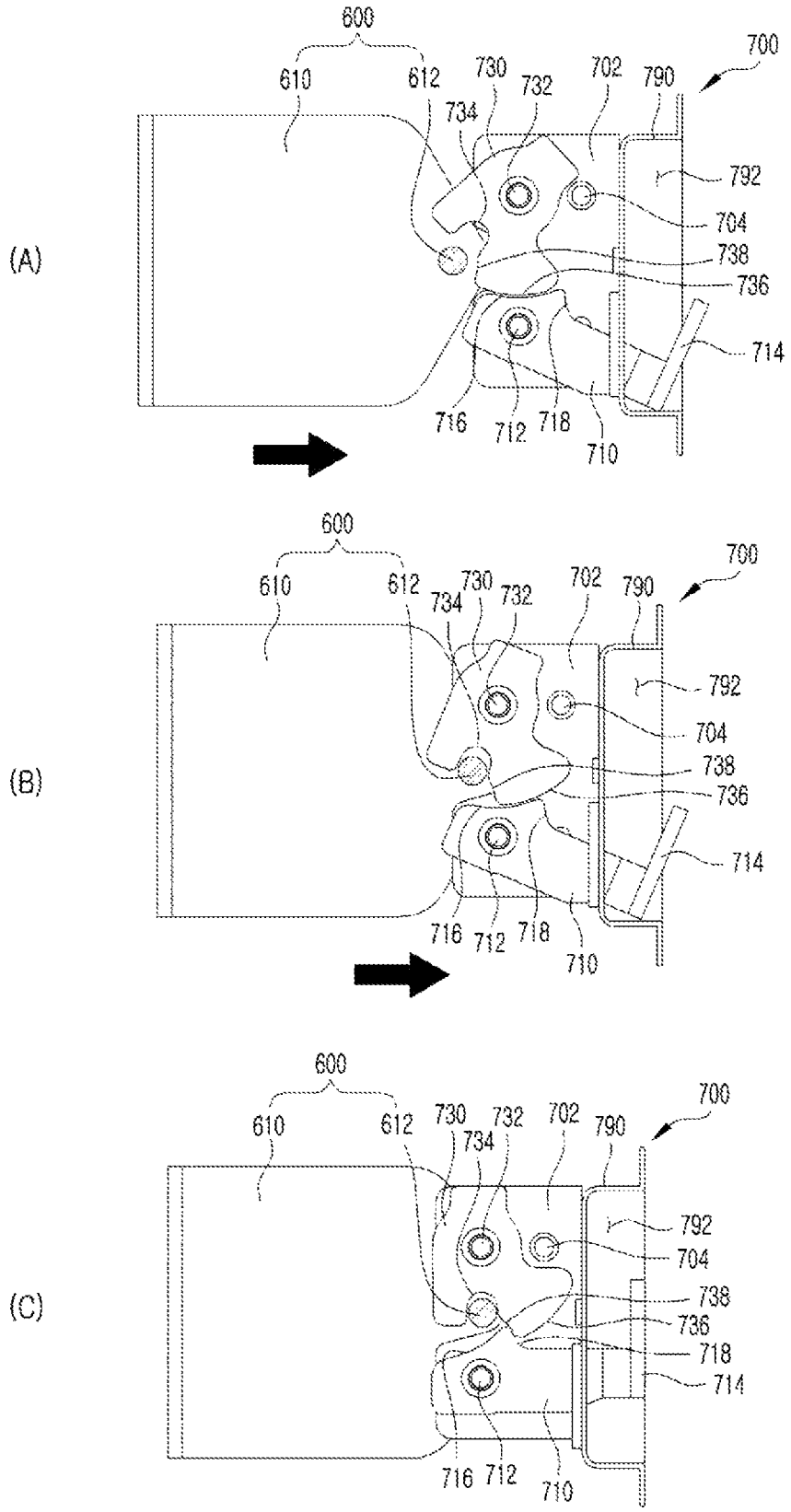
FIG. 7 is a set of diagrams sequentially showing driving of a latch assembly.

FIG. 7 is a set of diagrams sequentially showing driving of the latch assembly 900.

As shown in FIG. 7A, before the hang bar 612 is coupled to the latch 700, the lever curve portion 716 and the catcher curved portion 736 may interfere with each other to limit pivot of the lever 710 and the catcher 730.

Then, as shown in FIG. 7B, when the hang bar 612 gets closer to the latch 700, the hang bar 612 may be inserted into the catcher groove 734 while pivoting the catcher 730 in an opposite direction (counterclockwise) to the elastic force.

Then, as shown in FIG. 7C, when the hang bar 612 further pivots the catcher 730 counterclockwise to be completely inserted into the catcher groove 734, the catcher stopper 738 may interfere with the lever stopper 718 and may be prevented from pivoting clockwise even if there is elastic force by the elastic member.

In this case, the hang bar 612 may be completely inserted into and accommodated in the catcher groove 734, and thus the hang bar 612 may not be released.

In order to increase the distance between the first side wall 305B and the second side wall 305A again, that is, to unfold the main body 300 back to the original state, the aforementioned operations may be performed in reverse order.

That is, when a worker pulls the handle 714 of the lever 710 in the state of FIG. 7C, the lever 710 may pivot clockwise. In this case, when the lever 710 pivot clockwise at a predetermined angle or greater, interference of the catcher stopper 738 with the lever stopper 718 may be released and the catcher 730 may pivot clockwise by elastic force, as shown in FIG. 7B.

Then, as shown in FIG. 7A, the hang bar 612 may be released from the catcher groove 734, and the coupling relationship between the bracket 600 and the latch 700 may be released.

Figure 8:
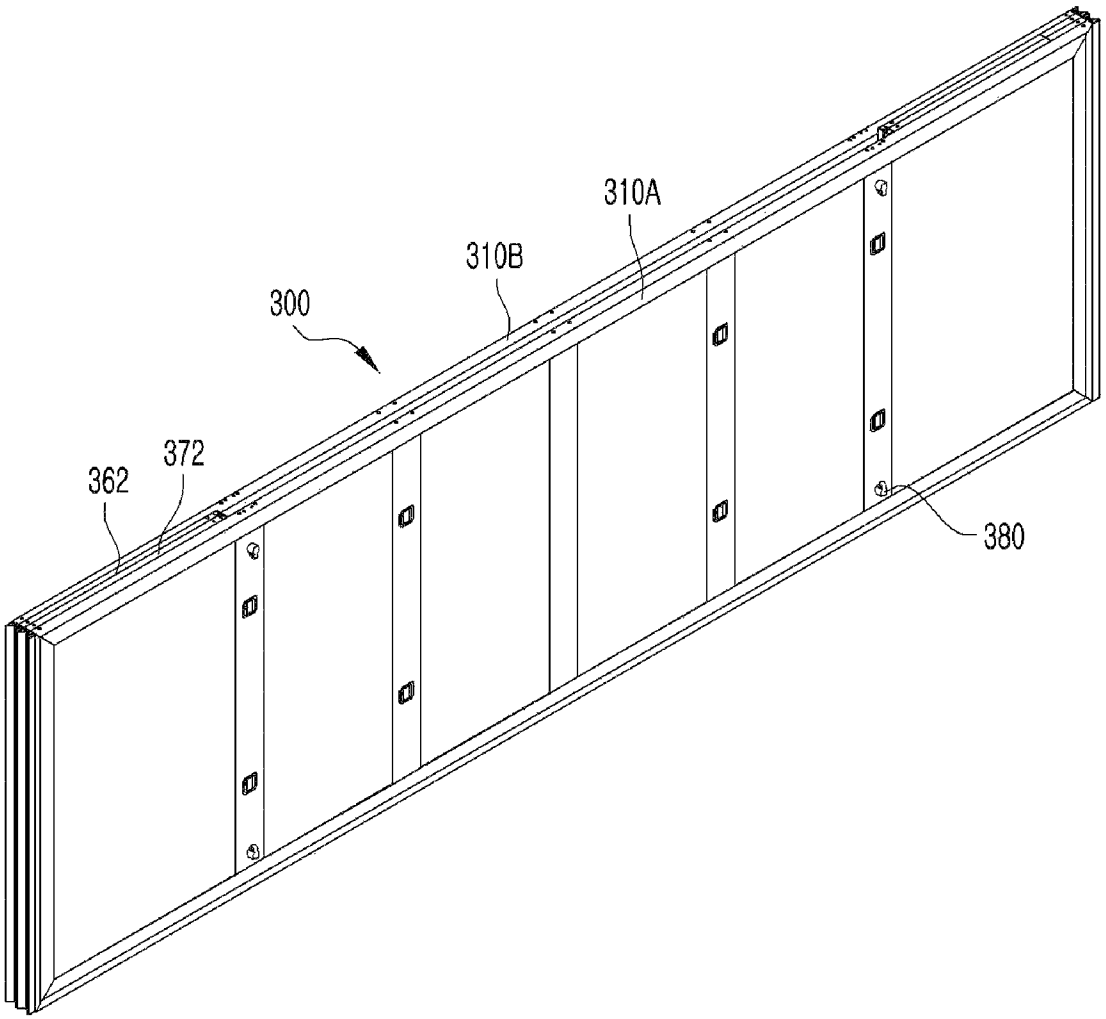
FIG. 8 is a perspective view of a main body after operations of FIG. 7 are performed.

FIG. 8 is a perspective view of the main body 300, the volume of which is minimized through the aforementioned operations of FIG. 7.

Referring to FIG. 8, when the first connection walls 362 and 342 and the second connection walls 372 and 352 of the main body 300 pivot using the aforementioned first hinge portion 400 and the second hinge portion 500, respectively and the reduced distance between the first side wall 305B and the second side wall 305A is fixed by the latch assembly 900, the main body 300, the volume of which is entirely and remarkably reduced, may be achieved, as shown in FIG. 8.

Figure 9:
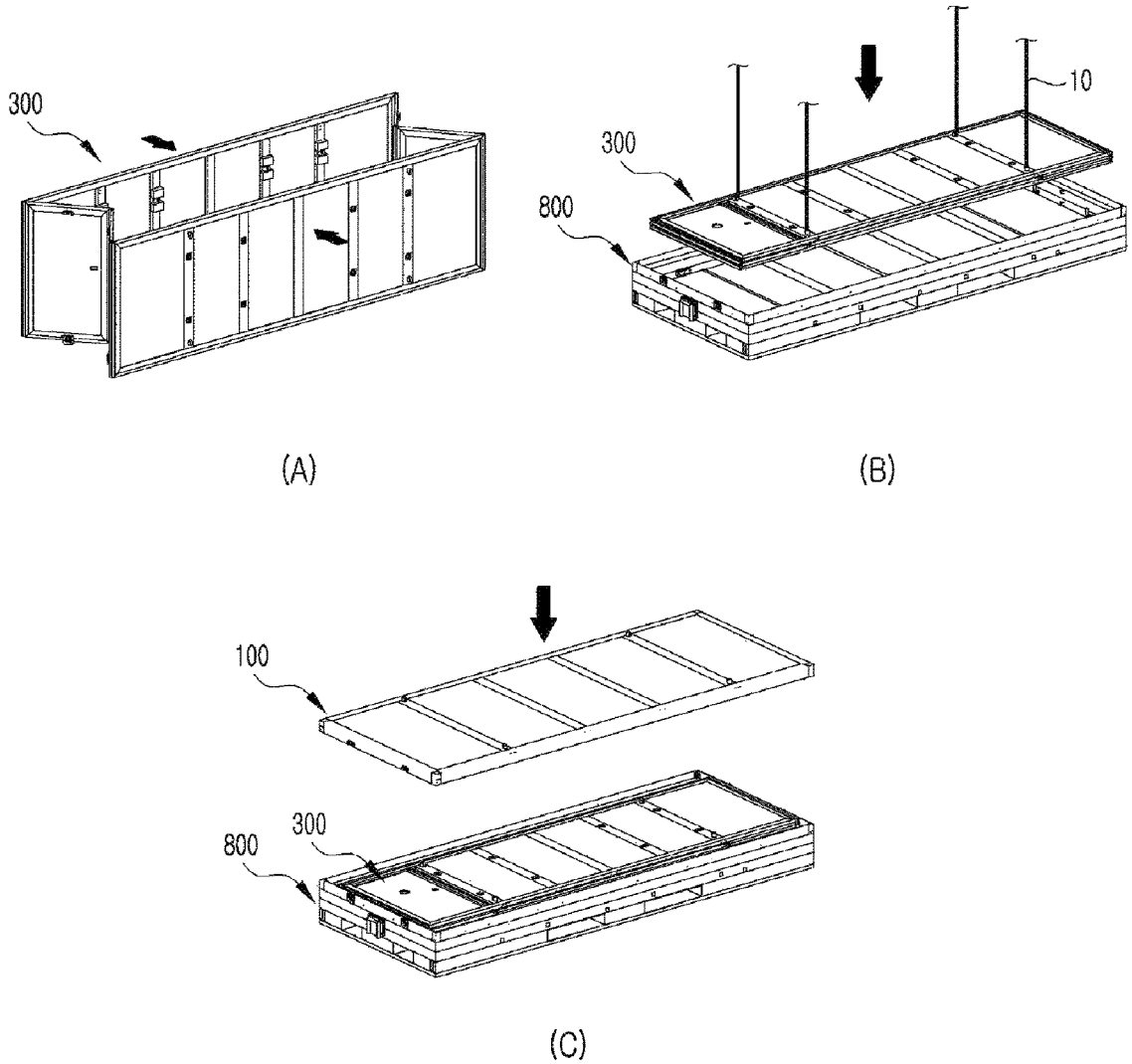
FIG. 9 is a set of diagrams showing an assembling process for reducing the volume of a carrying box including the main body.

FIG. 9 is a set of diagrams showing an assembling process for reducing the volume of the carrying box 1000 when the carrying box 1000 including the main body 300 is retrieved.

First, as shown in FIG. 9A, the volume of the main body 300 may be reduced. In this case, the first connection walls 362 and 342 and the second connection walls 372 and 352 of the main body 300 may pivot using the aforementioned first hinge portion 400 and second hinge portion 500, and the reduced distance between the first side wall 305B and the second side wall 305A may be fixed by the latch assembly 900.

In this case, as shown in FIG. 9B, the main body 300 folded flat may be coupled to an internal side of an upper portion of the aforementioned pallet 800.

In this case, the rope 10 may be connected to the aforementioned hook member 380, and the main body 300 may be stably moved by the rope 10.

That is, the main body 300 may be lifted and may be moved using the rope 10 connected to a lift device such as a crane (not shown).

The state in which the main body 300 is not in an opened state may be maintained by coupling the main body 300 to the aforementioned latch assembly 900 in the state in which the main body 300 is folded flat. In this case, even if the main body 300 is laid on its side and is lifted by the rope 10, the main body 300 may not be opened, and thus it may be possible to move the main body 300 using the rope 10.

Accordingly, the main body 300 may be accommodated inside the pallet 800 by moving the main body 300 above the pallet 800 by the rope 10 and lowering the main body 300. The main body 300 may be accommodated inside the pallet 800, and then the rope 10 may be removed.

Then, as shown in FIG. 9C, the cover 100 may be coupled to an upper portion of the pallet 800.

Thus, when the carrying box 1000 that terminates transportation is retrieved, the volume of the carrying box 1000 may be remarkably reduced as shown in FIG. 9, and accordingly logistics cost consumed to retrieve the carrying box 1000 may be remarkably reduced.

The present disclosure may be modified and implemented in various forms, and thus the scope of the present disclosure is not limited to the aforementioned embodiments. Accordingly, it will be obvious that the modified embodiment belongs to the scope of the present disclosure as long as the modified embodiment includes the components of the claims.

What is claimed is:

1. A main body of a carrying box, comprising:

a first side wall and a second side wall that form a side wall of the main body;

a pair of first connection walls and a pair of second connection walls that are pivotally hinged to opposite ends of the first side wall, respectively, and the second side wall and are pivotally hinged to each other to overlap each other; and a latch assembly configured to, when a distance between the first and second side walls is reduced, maintain the reduced distance between the first and second side walls, wherein the latch assembly comprises:

a bracket disposed at the first side wall; and a latch disposed at the second side wall, wherein the bracket is fastened to the latch when the bracket and the latch are pressed toward each other, wherein, when the pair of first connection walls and the pair of second connection walls pivot to overlap each other, the distance between the first side wall and the second side wall is reduced and a volume of the main body is reduced, wherein the bracket includes a hang bar, and the latch includes a lever and a catcher that rotate to fix the hang bar to the catcher when the bracket and the latch are pressed toward each other.

2. The main body of the carrying box of claim 1, wherein the pair of first connection walls and the pair of second connection walls are pivotally hinged to an end and a remaining end of the first side wall and an end and a remaining end of the second side wall, respectively, by a second hinge portion, and the pair of first connection walls and the pair of second connection walls are pivotally hinged to each other by a first hinge portion.

3. The main body of the carrying box of claim 2, wherein the pair of first connection walls and the pair of second connection walls pivot in an opposite direction to the end and the remaining end of the first side wall and the end and the remaining end of the second side wall, respectively, to overlap each other from a position at which the first connection walls and the second connection walls are perpendicularly connected to the end and the remaining end of the first side wall and the end and the remaining end of the second side wall, respectively.

4. The main body of the carrying box of claim 3, wherein the first hinge portion is disposed between a first connection wall and a second connection wall, and pivotally hinge the first connection wall and the second connection wall to overlap each other from a state in which the first connection wall and the second connection wall are disposed in a straight line.

5. The main body of the carrying box of claim 4, wherein the first hinge portion includes:

a first central hinge housing and a second central hinge housing that are detachably connected to an end of the first connection wall and an end of the second connection wall, which face each other, respectively; and a central elastic member configured to pivotally hinge the first central hinge housing and the second central hinge housing to each other.

6. The main body of the carrying box of claim 5, wherein:

a first central fixing member and a second central fixing member are fixedly inserted into the first central hinge housing and the second central hinge housing, respectively; and opposite ends of the central elastic member are fixed to the first central hinge housing and the second central hinge housing by the first central fixing member and the second central fixing member, respectively.

7. The main body of the carrying box of claim 3, wherein the second hinge portion is disposed between the first side wall and the first connection wall or between the second side wall and the second connection wall, pivotally hinges the first side wall and the first connection wall to overlap each other from a state in which the first side wall and the first connection wall are perpendicularly connected to each other, and pivotally hinges the second side wall and the second connection wall to overlap each other from a state in which the second side wall and the second connection wall are perpendicularly connected to each other.

8. The main body of the carrying box of claim 7, wherein the second hinge portion includes:

a first corner hinge housing and a second corner hinge housing that are detachably connected to an end of the first side wall and an end of the first connection wall, which face each other, respectively, or an end of the second side wall and an end of the second connection wall, which face each other, respectively; and a corner elastic member configured to pivotally hinge the first corner hinge housing and the second corner hinge housing to each other.

9. The main body of the carrying box of claim 8, wherein:

a first corner fixing member and a second corner fixing member are fixedly inserted into the first corner hinge housing and the second corner hinge housing, respectively; and opposite ends of the corner elastic member are fixed to the first corner hinge housing and the second corner hinge housing by the first corner fixing member and the second corner fixing member, respectively.

10. The main body of the carrying box of claim 1, wherein:

the latch further includes a latch frame disposed on any one of the first side wall and the second side wall;

the lever is pivotally installed on the latch frame, a handle of one end of the lever is exposed to an outside, and a lever stopper and a lever curve portion are formed at a remaining end; and the catcher is pivotally disposed at the latch frame, is provided with elastic force to pivot in one direction, and includes a catcher groove in which the hang bar is accommodated, a catcher curved portion, and a catcher stopper.

11. The main body of the carrying box of claim 10, wherein:

before the hang bar is coupled to the latch, the lever curve portion and the catcher curved portion interfere with each other to limit pivot of the lever and the catcher; and when the hang bar is inserted into the catcher groove while pivoting the catcher in an opposite direction to the elastic force, the lever stopper and the catcher stopper interfere with each other to limit pivot of the catcher and to fix the hang bar to the catcher groove.

* * * * *